US008443609B2

(12) United States Patent
Doerr et al.

(10) Patent No.: US 8,443,609 B2
(45) Date of Patent: May 21, 2013

(54) GAS-TURBINE BURNER FOR A GAS TURBINE WITH PURGING MECHANISM FOR A FUEL NOZZLE

(75) Inventors: Thomas Doerr, Berlin (DE); Leif Rackwitz, Rangsdorf (DE); Waldemar Lazik, Teltow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1038 days.

(21) Appl. No.: 12/382,572

(22) Filed: Mar. 18, 2009

(65) Prior Publication Data

US 2009/0255263 A1 Oct. 15, 2009

(30) Foreign Application Priority Data

Mar. 18, 2008 (DE) ..... 10 2008 014 744

(51) Int. Cl.
*F02C 7/22* (2006.01)
*F02C 7/232* (2006.01)

(52) U.S. Cl.
USPC ..... 60/740; 60/742; 60/737; 60/39.094; 60/748; 60/739; 431/3

(58) Field of Classification Search
USPC ..... 60/779, 39.094, 39.091, 778, 746, 60/748, 739, 740, 737, 742; 431/3
See application file for complete search history.

(56) References Cited

U.S. PATENT DOCUMENTS

| | | | | |
|---|---|---|---|---|
| 5,243,816 | A * | 9/1993 | Huddas | 60/39.094 |
| 5,251,447 | A | 10/1993 | Joshi et al. | |
| 5,647,215 | A | 7/1997 | Sharifi et al. | |
| 5,735,117 | A | 4/1998 | Toelle | |
| 5,881,550 | A | 3/1999 | Toelle | |
| 6,073,436 | A * | 6/2000 | Bell et al. | 60/39.094 |
| 6,256,975 | B1 | 7/2001 | Dobbeling et al. | |
| 6,543,235 | B1 | 4/2003 | Crocker et al. | |
| 6,675,583 | B2 | 1/2004 | Willis et al. | |
| 6,735,949 | B1 | 5/2004 | Haynes et al. | |
| 6,898,938 | B2 * | 5/2005 | Mancini et al. | 60/748 |
| 6,959,535 | B2 * | 11/2005 | Mancini et al. | 60/39.094 |
| 6,993,916 | B2 | 2/2006 | Johnson et al. | |

FOREIGN PATENT DOCUMENTS

| | | |
|---|---|---|
| DE | 102007015311 | 10/2007 |
| EP | 1445540 | 8/2004 |
| WO | 9954610 | 10/1999 |

OTHER PUBLICATIONS

German Search Report dated Jan. 15, 2009 from counterpart German patent application.

* cited by examiner

*Primary Examiner* — William H Rodriguez
*Assistant Examiner* — Steven Sutherland
(74) *Attorney, Agent, or Firm* — Timothy J. Klima; Shuttleworth & Ingersoll, PLC

(57) ABSTRACT

A gas-turbine burner for a gas turbine includes a fuel nozzle 1 having several fuel exit holes 23, which are each connected to a fuel line 5, 7, 29, 30, through which fuel can be passed selectively Between individual fuel exit holes 23, different static pressures of the airflow are provided between fuel lines flown by fuel and fuel lines not flown by fuel.

19 Claims, 3 Drawing Sheets

GAS-TURBINE BURNER FOR A GAS TURBINE WITH PURGING MECHANISM FOR A FUEL NOZZLE

Figure 1:
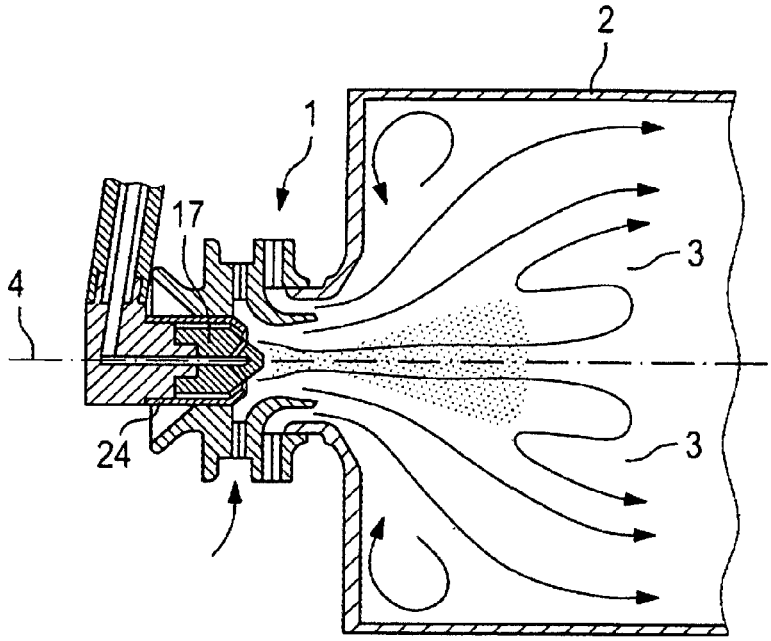
Fig. 1 (Prior Art)

This application claims priority to German Patent Application DE102008014744.3 filed Mar. 18, 2008, the entirety of which is incorporated by reference herein.

This invention relates to a gas-turbine burner as well as to a method for the purging of a fuel nozzle.

For the general state of the art for a burner of an aircraft gas turbine, reference is made to U.S. Pat. No. 6,543,235 B1, for example.

For reducing the thermally induced nitrogen oxide emissions, various concepts of fuel nozzles are known. One mechanism is the application of burners operating with a fuel-air mixture with high air excess. Here, use is made of the principle that the lean mixture, with adequate spatial homogeneity of the fuel-air mixture simultaneously being ensured, favors a reduction of the combustion temperatures and, thus, of the thermally induced nitrogen oxides.

Moreover, internal fuel staging is employed on many such burners. This means that, besides a main fuel injector designed for low NOx emissions, a pilot stage is integrated into the burner which is operated with an enriched fuel-air mixture and is intended to ensure stability of combustion as well as adequate combustion chamber burning and ignition properties. The fuel for the main stage of such a lean burner can here be introduced as closed film or, by way of discrete fuel exit holes, as multiple jets.

The variants for discrete jet injection are particularly vulnerable to fuel coking in the fuel exit holes due to the small bore diameters (mostly D<1.0 mm) and the fuel metering holes being arranged in the vicinity of hot gas-wetted components. This is caused by the thermal oxidation process setting in with increased heating of the fuel. From a fuel temperature of approx. 150° C. and a corresponding time of exposure to the thermal loading, the resultant chemical processes can lead to the formation of deposits.

Formation of deposits will firstly entail a change of the flow characteristics of the fuel in the fuel exit holes concerned which is caused by an increased pressure drop. Moreover, the fuel exit holes can become fully blocked. Both effects significantly degrade the fuel-air mixture in the combustion chamber, with the emission values thereby being increased and the temperature distribution within the combustion chamber as well as the temperature profile in the combustion chamber exit being affected. With heavy depositions, the service life of the combustion chamber and the turbine may consequently be impaired.

The risk of fuel coking increases if the fuel line is switched off and part of the fuel lines are no longer continuously supplied with fuel. For example, this may occur with staged lean burners when main burners are gradually or completely shut down in transiting between various load conditions. Part of the fuel may then stagnate in the fuel lines as the latter are no longer continuously flown and consequently, are heated by the high metal temperatures of the fuel lines and the radiation of the flame.

A broad aspect of the present invention is to provide a gas-turbine burner as well as a method for purging the latter, which combine simplicity of design and ease of application with operational safety, while avoiding deposits of fuel and of its reaction products in the area of the fuel nozzle.

In order to avoid the hazard of coking of the fuel in the fuel exit holes, a purging mechanism is proposed for the switched-off fuel lines of a burner which enables the fuel lines to be completely automatically cleared. Via suitable interconnection of individual fuel lines, the basic principle is to impress different static pressures $P_{a,i}$ in the exit cross-sections of the fuel lines and to produce pressure differences to automatically clear the fuel lines.

According to the present invention, the following measures are proposed to set different static exit pressures in the fuel lines to support draining of the manifold lines, the fuel lines and/or the fuel exit holes:

A. Profiling the surface contour of flow-conveying components before the fuel exit holes.

B: Selection of suitable output locations for fuel injection with different static pressures of the airflow.

C. Staggered arrangement of the fuel exit holes.

D. Adaptation of vane setting and profiling for air swirler.

E. Different hole diameters of discrete injection.

F. Directional control valve in the burner for air purging.

In accordance with the present invention, combinations of the measures A to E are also possible. Furthermore the use of a directional control valve with two switching positions is advantageous (measure F).

Figure 4:
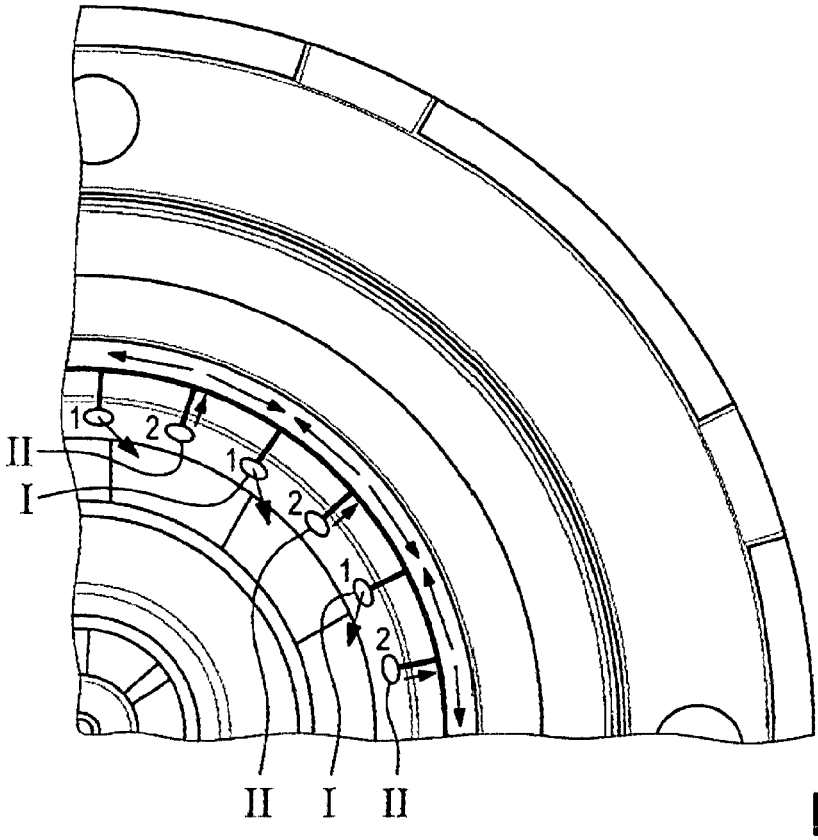
Figure 5:
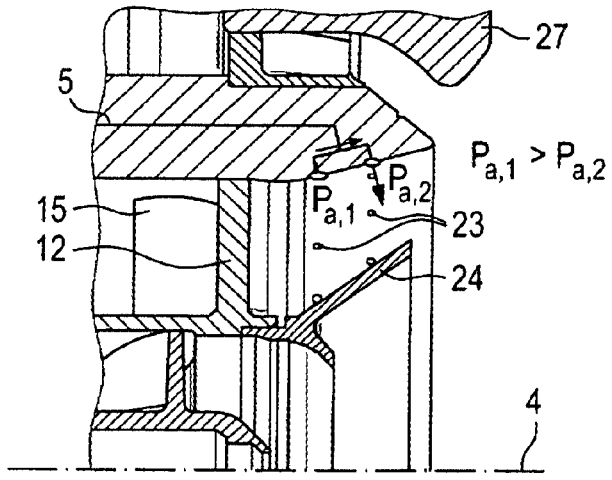
Figure 6:
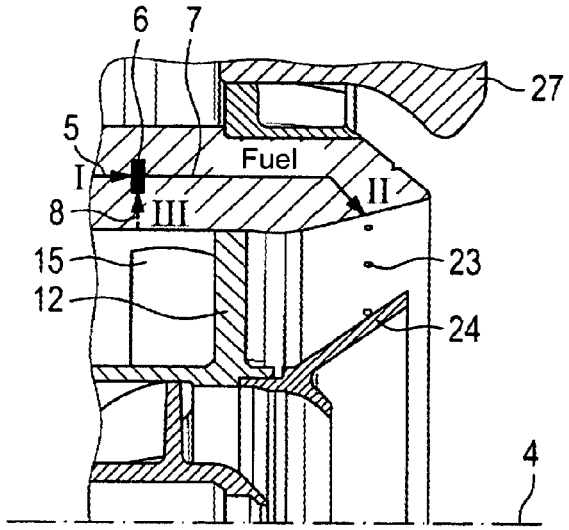
Figure 7:
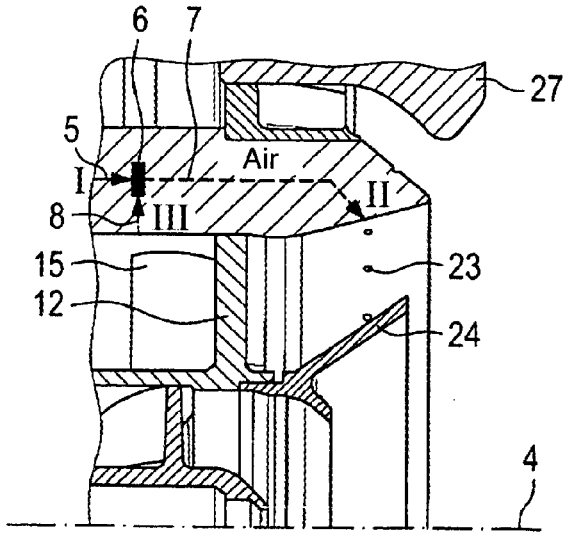

The present invention is more fully described in light of the accompanying drawings showing preferred embodiments. In the drawings, FIG. 1 (Prior Art) is a schematic representation of a burner for an aircraft gas turbine according to the state of the art, FIG. 2 is a schematic representation of main components of a lean burner in accordance with the present invention with controlled fuel inhomogeneity in the main stage, FIG. 3 is a schematic representation of the positioning of the measures provided according to the present invention for supporting the process of draining stagnant fuel for the main stage of a lean burner, FIG. 4 is a schematic, partial representation of the basic principle in accordance with the present invention for draining the main fuel lines by varying the pressure present at the fuel exit holes, FIG. 5 is a schematic representation of the staggered arrangement of the fuel exit holes, making use of the different pressures present at the fuel exit holes for automatic draining of the fuel lines, FIG. 6 is a schematic representation of the draining process of stagnant fuel for the main stage of a lean burner by means of a directional control valve in switching position 1 (fuel flowing through the fuel line to the fuel exit hole), and FIG. 7 is a representation, analogically to FIG. 6, in switching position 2 for conveying purging air through part of the fuel line.

FIG. 1 (Prior Art) schematically shows an example of the state of the art. Here, a fuel nozzle 1 is provided which has a burner axis 4 and is associated to a combustion chamber 2 in which a combustion chamber flow 3 takes place. Reference numeral 17 exemplifies a pilot fuel injector.

Figure 2:
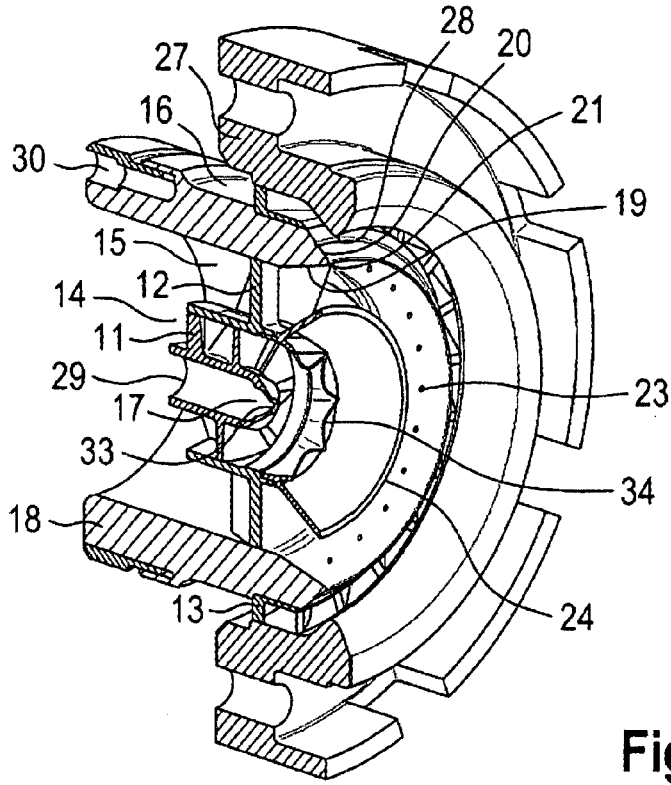

FIG. 2 shows a lean burner with controlled fuel inhomogeneity for a main stage of a gas-turbine burner. The lean burner includes an inner swirler 11 as well as a center swirler 12 and an outer swirler 13 associated to an inner flow duct 14 as well as a center flow duct 15 and an outer flow duct 16. Reference numeral 17 indicates a pilot fuel injector, while a main fuel injector is marked 18. Also provided is an inner downstream surface of the main fuel injector (film applicator) 19. Reference numeral 20 designates an outer surface of the main fuel injector whose trailing edge is marked 21. Reference numeral 23 indicates fuel exit holes/apertures of the main fuel injector. Reference numeral 24 indicates a flame stabilizer. Also provided is an outer dome 27. Reference numeral 28 indicates the inner contour of the outer dome 27. Also provided are a pilot fuel supply 29 and a main fuel supply 30. Reference numeral 33 indicates an exit surface of the pilot fuel injector, while reference numeral 34 indicates an exit contour of the inner leg of the flame stabilizer.

Figure 3:
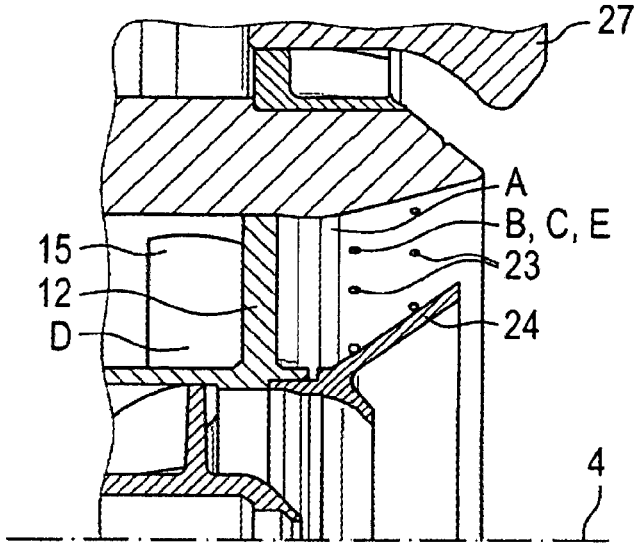

FIG. 3 schematically shows various measures for impressing the different static pressures of the air supply (airflow) and producing pressure differences. This supports the process of draining stagnant fuel for the main stage of a lean burner.

According to measure A, provision is made for profiling the surface contour of flow-conveying components before the fuel exit holes 23 so that different pressures are obtained in the area of the fuel exit holes 23 resulting in drainage (sucking out) of the fuel lines.

According to the schematically shown measures B and C, the output locations and arrangements of the fuel exit holes 23 are selectable such that different static pressures are obtained. According to measure C, provision is made for a staggered arrangement of the fuel exit holes along the burner axis 4.

According to measure D, the vane setting and/or the profiling of the air swirler (air swirl generator) 12 in the center flow duct 15 are changeable. This leads to different pressure conditions which differently impact on the individual fuel exit holes 23 and, consequently, result in underpressure (suction effect).

According to measure E, it is also possible to provide different hole diameters of the discrete fuel injector.

FIG. 4 shows, in schematic representation, the basic principle of the present invention for draining the main fuel lines by varying the pressure present at the fuel exit holes 23. FIG. 4 shows an example in which the use of a smaller static pressure for each other fuel exit hole marked with I in the Figure and disposed in alternation with fuel exit holes II is provided.

FIG. 5 is a schematic representation in which a staggered arrangement of the fuel exit holes 23 along the burner axis 4 is provided. FIG. 5 illustrates the different pressure conditions with the staggered fuel exit holes 23 being associated to a fuel line 5.

FIGS. 6 and 7 each show the application of a directional control valve 6 in the fuel line 5. FIG. 6 shows a switching position of the directional control valve 6 in which fuel is conveyed through the fuel line 5 into a free area of a subsequent fuel line 7 which is connected to the fuel exit hole 23. A purging line 8 is here inoperative.

FIG. 7 shows a switching position of the directional control valve 6 in which air is conveyed through the purging line 8 into the fuel line 7 and, thus, to the fuel exit hole 23, while the supply of fuel through the fuel line 5 is interrupted. This measure corresponds to measure E.

The following shall therefore be noted:

The position of the respective design measures for a burner is schematically shown in FIG. 2. In this connection, the measures are transferable to any burner with corresponding discrete fuel injection, with the application being exemplified in FIG. 2 for a known lean burner.

The principle of draining stagnant fuel by making use of different static pressures on the components of the fuel nozzle or by specific, local variation of the static pressure at the fuel exit holes is shown in FIG. 3.

All of the measures described in the above are intended to position the various output locations for fuel such that, on the one hand, different local static pressures of the airflow can be used to drain stagnant fuel and, on the other hand, an optimized fuel-air mixture is provided which ensures lowest emissions. As a result of the different static pressures of the air at the surface (wall pressures), air enters the one recess of the fuel line, thereby draining or discharging the fuel from the other recess.

Measure A—Profiling the surface contour before the fuel exit holes and

Measure D—Adaptation of vane setting and profiling:

Variation of the static pressure in the circumferential direction is obtainable by suitably designing a flow-wetted component situated upstream of the fuel injection, for example by circumferentially profiling the surface geometry in the form of lamellation. By specifically tuning the surface contour to the number and position of the exit holes, the pressure difference existing when the main fuel is cut off can then effect drainage of the stagnant fuel. A similar effect is obtainable by adapting the circumferential variation of the vane setting of the air swirler in the flow duct of the main stage, in particular on the outer radius, and by variation of the vane profiling.

Measure B—Selection of suitable output locations for fuel injection, making use of an already existing variation of static pressures:

Further, different static pressure drops for the fuel holes are settable by a suitable selection of the output locations on the inner contour of the main stage. Here, the existence of a static pressure distribution occurring in the aerodynamics of the burner is used to position the interconnected fuel exit holes in areas of high or low static pressures, respectively, and produce a pressure difference necessary for draining the stagnant fuel (see FIG. 4).

Measure C—Staggered arrangement of the fuel exit holes:

As a further measure, different interconnection of the fuel lines, for example of more than two fuel lines and/or different positioning of interconnected fuel exit holes in both axial and circumferential direction, is proposed.

Measure E—Different hole diameters of discrete injection:

Besides the methods described in the above, it is further proposed for the setting of different pressure levels at the fuel exit holes that different bore diameters are provided for interconnected fuel lines to enable fuel to be automatically drained again by different static pressures applied.

Measure F—Directional control valve:

Another method of automatic drainage is the integration of a directional control valve with for example two switching positions into the burner (see FIG. 5). In normal operation, the main fuel continuously flows through the directional control valve. When the fuel is cut off, the directional control valve is moved into a second switching position in which the continuous flow of the fuel is interrupted. By providing appropriate duct geometries, which can be situated either in the center air duct or upstream in the burner leg, a mechanism is provided for the purging air to flow continuously. Thus, complete drainage of the fuel lines is ensured. Upon cutting in the fuel again, movement of the directional control valve into the initial position will release the fuel while simultaneously closing the purging air duct.

The following advantages are, among others, provided by the present invention:

Prevention of coking in the fuel ducts of burners,

Prevention of a degradation of the operating characteristics of the combustion chamber or the engine (with regard to emissions, vibration tendency, temperature profile in the exit of the combustion chamber, service life of combustion chamber and turbine etc).

LIST OF REFERENCE NUMERALS

1 Fuel nozzle
2 Combustion chamber
3 Combustion chamber flow
4 Burner axis
5 Fuel line

6 Directional control valve
7 Fuel line
8 Purging line
11 Inner swirler
12 Center swirler
13 Outer swirler
14 Inner flow duct
15 Center flow duct
16 Outer flow duct
17 Pilot fuel injector
18 Main fuel injector
19 Inner, downstream surface of main fuel injector, film applicator
20 Outer surface of main fuel injector
21 Trailing edge of main fuel injector
23 Fuel exit holes of main fuel injector
24 Flame stabilizer
27 Outer dome
28 Inner contour of the outer dome
29 Pilot fuel supply
30 Main fuel supply
33 Exit surface of pilot fuel injector
34 Exit contour of inner leg of flame stabilizer

What is claimed is:

1. A burner for a gas turbine, comprising:

a fuel nozzle having a plurality of fuel exit holes, each connected to a fuel line, through which fuel is selectively passed, wherein certain ones of the fuel exit holes are selectively subjected to different static pressures of airflow through the burner than others of the fuel exit holes interconnected with the certain ones to create a purging air flow through the fuel exit holes;

wherein a surface contour of flow-wetted components upstream of the fuel exit holes has a convergent profile and the convergent profile provides the different static pressures.

2. The burner of claim 1, wherein the different static pressures are provided by selecting different pressures in the fuel lines.

3. The burner of claim 1, wherein the certain ones of the fuel exit holes are positioned in burner areas with different static pressures than the others of the fuel exit holes.

4. The burner of claim 3, wherein the certain ones of the fuel exit holes are staggered with respect to the others of the fuel exit holes with reference to a burner axis.

5. The burner of claim 1, and further comprising swirler vanes that generate pressure differences between fuel exit holes.

6. The burner of claim 5, wherein a setting of vanes provides for the generation of pressure differences between fuel exit holes.

7. The burner of claim 5, wherein a profiling of the vanes provides for the generation of pressure differences between fuel exit holes.

8. The burner of claim 1, wherein the certain ones of the fuel exit holes have different bore diameters than the others of the fuel exit holes.

9. The burner of claim 1, and further comprising at least one directional control valve for selectively applying purging to the fuel lines.

10. A method for draining fuel lines of a nozzle of a gas-turbine burner, comprising:

subjecting at least one group of fuel exit holes to a different static pressure than another group of interconnected fuel exit holes to create a purging airflow through the fuel exit holes;

providing a surface contour of flow-wetted components upstream of the fuel exit holes with a convergent profile to provide the different static pressure.

11. The method of claim 10, wherein the different static pressures are provided by selecting different pressures in the fuel lines.

12. The method of claim 10, wherein the different static pressures are created by different positioning of the one group with respect to the other group in the nozzle to be respectively exposed to different static pressures in the nozzle.

13. A fuel nozzle, comprising a plurality of fuel exit holes selectively connectable between at least one line connected to a pressurized fuel supply for supplying fuel to a gas turbine from the fuel exit holes and an air supply for purging fuel from the at least one line, wherein certain ones of the fuel exit holes are selectively subjected to different static pressures of airflow through the fuel nozzle than others of the fuel exit holes interconnected with the certain ones to create a purging air flow through the fuel exit holes; wherein a surface contour of flow-wetted components upstream of the fuel exit holes has a convergent profile and the convergent profile provides the different static pressures.

14. The fuel nozzle of claim 13, wherein the air supply is selectively connected by blocking the connection to the pressurized fuel supply.

15. The fuel nozzle of claim 13, and further comprising a directional control valve connected to the at least one line that can be opened to selectively connect the fuel exit holes to the air supply for purging fuel.

16. A fuel nozzle, comprising:

a first aperture set and a second aperture set, at least one of the aperture sets selectively connected to a fuel supply for supplying fuel to the gas turbine, at least one aperture of the first aperture set being flowingly connected by at least one line to at least one aperture of the second aperture set, the at least one line selectively supplying fuel to at least one of the apertures of the first and second aperture sets, the fuel nozzle configured and arranged to provide a higher air pressure at the at least one aperture of the first aperture set than at the at least one aperture of the second aperture set such that when a flow of pressurized fuel is shut-off to the at least one aperture set for supplying fuel, a pressure differential between the higher air pressure aperture and the lower air pressure aperture causes air to flow through the line between the higher air pressure aperture and the lower air pressure aperture to purge fuel from the line;

wherein a surface contour of flow-wetted components upstream of the fuel exit holes has a convergent profile and the convergent profile provides the higher and lower air pressures.

17. The fuel nozzle of claim 16, wherein the at least one aperture of the first aperture set is selectively connected to the at least one aperture of the second aperture set by a directional control valve.

18. The fuel nozzle of claim 16, wherein the at least one line selectively supplies fuel to both of the at least one aperture of the first aperture set and the at least one aperture of the second aperture set.

19. The fuel nozzle of claim 16, wherein the first aperture set comprises a plurality of apertures, the second aperture set comprises a like plurality of apertures and each of the apertures in the first aperture set is connected to a counterpart aperture of the second aperture set by a respective line.

* * * * *